US005144997A

United States Patent [19]

Marasco et al.

[11] Patent Number: 5,144,997

[45] Date of Patent: Sep. 8, 1992

[54] DRAPERY FIXTURE

[75] Inventors: Angelo M. Marasco, Madison, Wis.; Dorothy C. Shepherd, Edina, Minn.; Daniel C. Johnson, Madison, Wis.

[73] Assignee: Graber Industries, Inc., Middleton, Wis.

[21] Appl. No.: 743,078

[22] Filed: Aug. 9, 1991

[51] Int. Cl.[5] ..... A47H 1/00

[52] U.S. Cl. ..... 160/349.2; 160/38; 428/4

[58] Field of Search ..... 160/38, 330, 349.1, 160/349.2, 348, 392; 428/4; 223/46, 44

[56] References Cited

U.S. PATENT DOCUMENTS

| | | | |
|---|---|---|---|
| 1,831,169 | 11/1931 | Geraldine | 160/349.2 X |
| 1,927,061 | 9/1933 | Chapman | 428/4 X |
| 1,933,691 | 11/1933 | Young | 160/349.2 X |
| 2,637,384 | 5/1953 | McCabe . | |
| 4,284,258 | 8/1981 | Kleiman . | |
| 4,527,719 | 7/1985 | Mackrill | 428/4 X |
| 4,559,988 | 12/1985 | Nocerino . | |
| 4,903,370 | 2/1990 | Erdmann . | |
| 4,912,829 | 3/1990 | Hickey . | |
| 4,958,646 | 9/1990 | Hannershg . | |

*Primary Examiner*—Blair M. Johnson
*Attorney, Agent, or Firm*—Vernon J. Pillote

[57] ABSTRACT

A drapery fixture for use as a drapery swag holder or a drapery tie-back holder. The fixture includes a mounting bracket and rosette components for use with a piece of fabric for forming a fabric rosette. The rosette components include a shape retaining rosette body member having a front face and a central opening through the front face, and a plug member dimensioned for insertion into the central opening for retaining a fabric piece adjacent the center of the front face of the body member. A fabric receiving recess is provided at the rear side of the body member and a flexible strip can be pressed into the fabric receiving groove to retain the fabric at the rear side of the body member.

12 Claims, 2 Drawing Sheets

FIG. 5
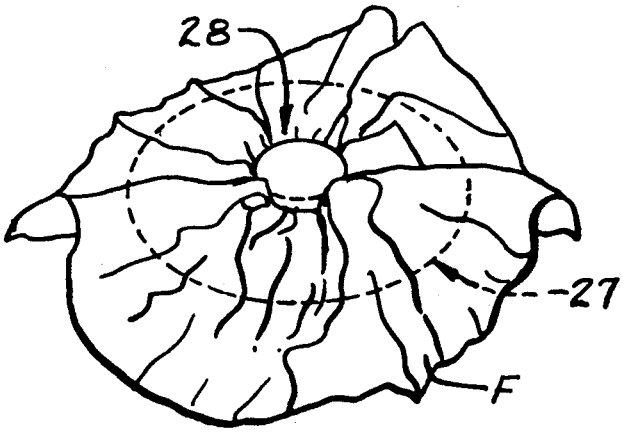
FIG. 7
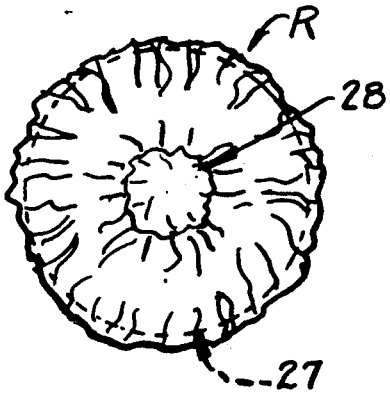
FIG. 6
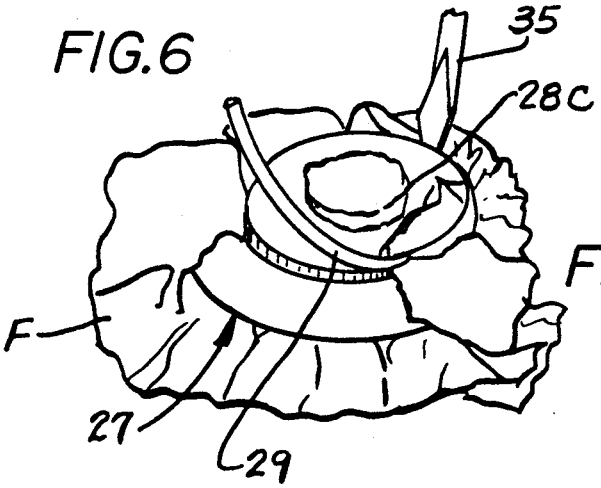
FIG. 8
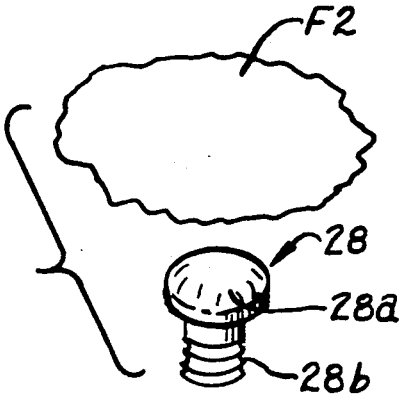
FIG. 9
FIG. 11
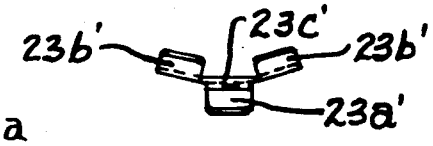
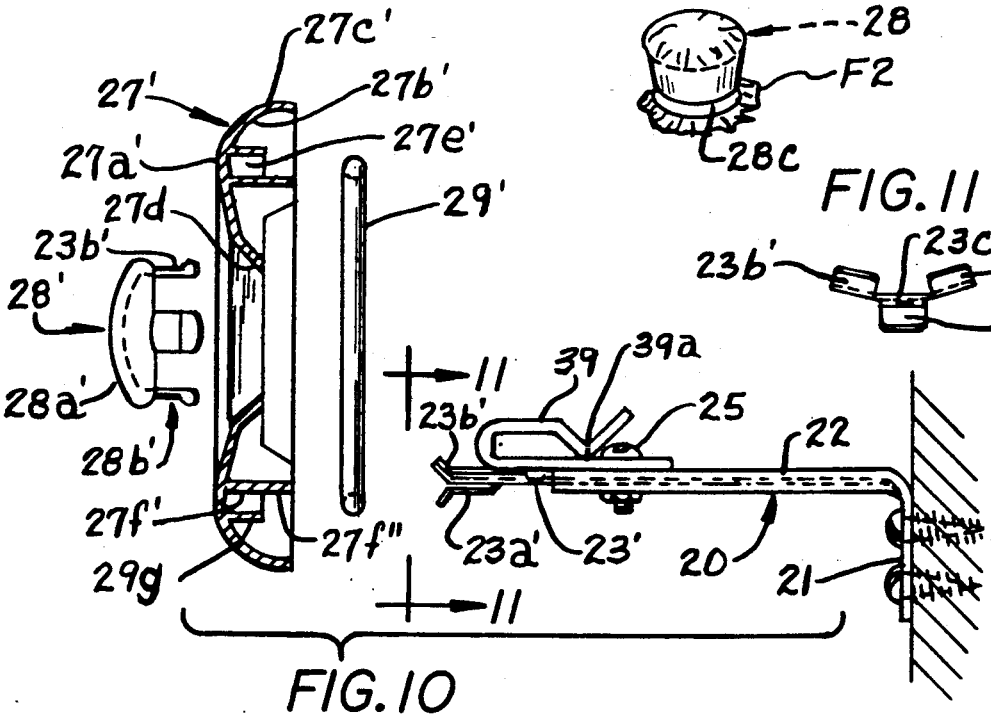
FIG. 10

DRAPERY FIXTURE

BACKGROUND OF THE INVENTION

It is common practice to make drapery swag holders and drapery tie-back holders with decorative end members of various configurations at the forward end of the holder, some examples of which are disclosed in U.S. Pat. Nos. 4,284,258; 4,559,988; 4,903,370 and 4,912,829. It has also been proposed as disclosed in U.S. Pat. No. 4,912,829, to provide a decorative end member for a drapery tie-back holder which can be covered with fabric to coordinate with a color or pattern of the drapery. Swag holders have also been made, for example as disclosed in U.S. Pat. Nos. 2,637,384 and 4,958,646, with decorative end members arranged so that the material of the swag can be drawn forwardly through an opening in the decorative end members and arranged in a rosette form to provide a fabric rosette at the forward end of the swag holder. However, it requires considerable skill and time to form the fabric rosettes from the drapery swag, while maintaining the desired swag drape between the spaced swag holders and equal and symmetrical depending swag end portions.

SUMMARY OF THE INVENTION

It is an object of the present invention to provide a drapery fixture for use as a drapery swag holder or a drapery tie-back and which facilitates providing fabric rosettes on forward ends of the holders.

Accordingly, the present invention provides a drapery fixture for use as a drapery swag holder or drapery tie-back holder comprising a mounting bracket having a rear mounting portion and an arm extending forwardly from the rear mounting portion, and rosette components for use with a piece of fabric for forming a fabric rosette adapted for attachment to the forward end of the mounting bracket. The rosette components include a shape retaining rosette body member having a front face, a rear side, an outer periphery and an opening generally centrally of the outer periphery. The rosette components also include a plug member dimensioned for insertion into the central opening from the front face of the body member for retaining a fabric piece adjacent the center of the front face of the body member, and a rear fabric retaining means fcr attaching a fabric piece to the rear side of the body member in a locus inwardly of the outer periphery and outwardly of the central opening. Rosette mounting means are provided for detachably connecting the forward end of the arm means to the rear side of the rosette body member.

Insertion of the plug member through a piece of fabric into the central opening in the body member draws the fabric into pleats or folds and the plug member retains the fabric piece adjacent the center of the front face of the body member while the fabric piece is folded over and secured to the rear side of the body member.

BRIEF DESCRIPTION OF THE DRAWINGS

FIG. 5 is a perspective view diagrammatically illustrating insertion of the plug member through a piece of fabric into the opening in the rosette body;

FIG. 6 a perspective view diagrammatically illustrating folding of the fabric piece over the rear side of the body and attaching the fabric piece to the rear side of the body;

FIG. 7 is a front view illustrating a fabric rosette;

FIG. 8 is a perspective view diagrammatically illustrating a piece of fabric to an end of the plug member to cover the same;

FIG. 9 is a perspective view illustrating a plug member covered with a piece of fabric;

FIG. 10 is an exploded sectional view illustrating a modified form of drapery fixture; and FIG. 11 is an end view of the support arm taken on the plane 11—11 of FIG. 10.

DETAILED DESCRIPTION

Figure 3:
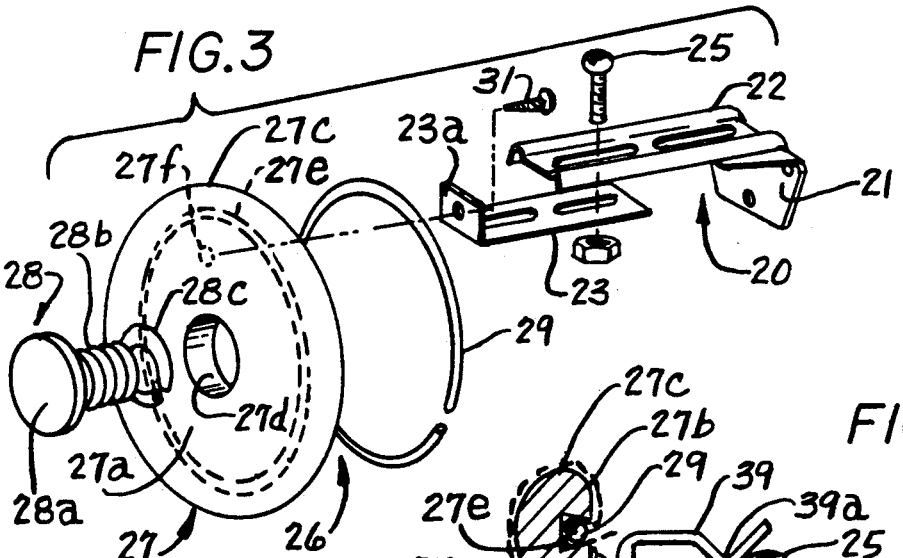
FIG. 3 is an exploded perspective view of the drapery fixture.

The drapery fixture includes a mounting bracket 20 having a rear mounting portion 21 and an arm 22 extending forwardly from the rear mounting portion. The mounting bracket is preferably adjustable and as shown in FIG. 3, includes an extension 23 which is slidable relative to the arm 22 and which can be secured in adjusted position by a fastener such as a bolt and nut 25 that extend through slots in the arm 22 and extension 23. The drapery fixture also includes rosette components designated generally by the numeral 26 for use with a piece of fabric for forming a fabric rosette R. The rosette components comprise a shape retaining rosette body member 27 having a front face **27*a*, a rear side 27*b*, an outer periphery 27*c* and a central opening 27*d* generally centrally of the outer periphery. The rosette body is herein shown with a circular periphery it being understood that the rosette body could be of various regular polygonal configuration. The body member may, for example, be formed of wood or molded synthetic resin material. The body member can be made in different sizes, for example in a range of three to six inches and the ratio of the diameter of the outer periphery to the central opening is preferably in a range from 2:1 to 4:1. In the preferred embodiment illustrated, the body member has an outer diameter of four and one-half inches and the center opening has a diameter of one and one-fourth inches. The rosette components also include a plug member 28 having a head 28*a* at one end and a stem 28*b* dimensioned for insertion into the central opening 27*d* for retaining a fabric piece adjacent the center of the front face of the body member. The front face of the body member is preferably formed with a concave central portion around the opening 27*d*** and a convex outer portion that merges with the outer periphery.

Rear fabric retaining means are provided for attaching a fabric piece at the rear side of the body member in a locus inwardly of the outer periphery of the body member and outwardly of the central opening. In the preferred embodiments illustrated, the rear fabric retaining means comprises an annular fabric receiving groove or recess **27*e* at the rear side of the body member inwardly of the outer periphery and outwardly of the central opening, and a resilient flexible fabric retaining strip 29, such a tube of resilient plastic or rubber, which is adapted to be pressed into the groove 27*e*. Means are provided for attaching the rosette body to the forward end of the arm, at a location outwardly of the central opening and inwardly of the rear fabric retaining groove. In the embodiment of FIGS. 1–9, the extension 23 has a flange 23***a* at its forward end and a fastener, such as a screw 31 receivable in a fastener receiving opening 27*f* in the body member, is provided for securing the flange 23*a* to the rear side of the rosette body. The mounting means is preferably arranged so that the rosette can be mounted in different angular positions relative to the bracket, for example with the rosette offset downwardly; upwardly; or to the left or to the right of the bracket. In this embodiment, the rosette body is adapted to be turned about the axis of the screw relative to the bracket extension and the screw thereafter tightened to hold the rosette in the angularly adjusted position.

The rosette body is adapted to be covered with a piece of fabric to make a fabric rosette. As shown in FIG. 5, a piece of fabric designated F is positioned over the front face of the rosette body member 27 and the plug member 28 is then pressed through the fabric and into the opening 27*d* in the body member. When the plug member is pressed through the fabric in the opening, it draws the fabric into the opening and forms pleats or folds in the fabric that extend outwardly from the opening as shown in FIG. 5. The plug member also retains the sheet of fabric adjacent the center of the front face of the body member. An outer margin of the sheet of fabric can then be progressively folded over into overlying relation with the rear side of the body member and secured at the rear side of the body member as shown in FIG. 6. As shown, the resilient strip 29 can be progressively pressed by a tool such as a screw driver 35 into the fabric receiving groove 27*e* to retain the fabric piece at the rear side of the body member. The finished rosette will have folds that extend outwardly from the central opening toward the outer periphery and the portion of the fabric piece that is folded inwardly at the rear side of the body member will also be folded or pleated in the course of attaching the fabric piece to the rear side of the body member. Further, the amount and size of the folds of pleats at the front side of the fabric member can be increased by pressing the center portion of the fabric piece through the opening to a distance somewhat greater than the length of the plug member and thereafter inserting the plug members in the fabric piece at the center of the front face of the body member.

Figure 4:
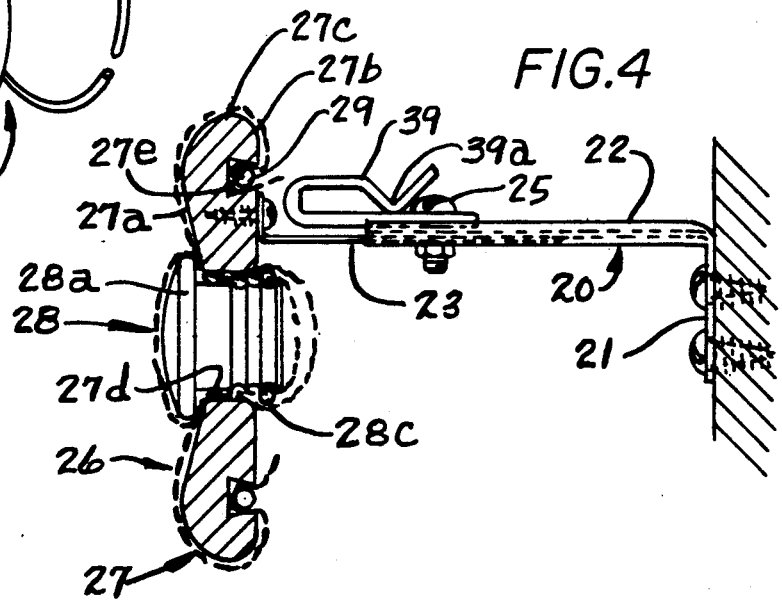
FIG. 4 is a sectional view of the drapery fixture.

The plug member 28 can be used without a covering to provide a contrasting button at the center of the fabric rosette. The plug member is also arranged so that the head 28*a* can be covered with a second piece of fabric F2 of the same or a different material from the fabric piece F1. As shown in FIGS. 8 and 9, the fabric piece F2 can be drawn over the head 28*a* of the plug member and along the sides of the stem 28*b* and retained in position by a band or wrap 28*c* (FIGS. 4 and 9). The band may, for example, be an elastic band on a cord tie. In the embodiment shown, the stem is advantageously provided with circumferential recesses or grooves to facilitate retaining the band against movement axially of the stem. This aids in holding the fabric piece F2 in a taut condition over the head, during insertion of the stem into the opening in the body member. The stem 28*b* on the plug 28 is dimensioned sufficiently smaller than the opening 27*d* to accommodate the fabric thickness when the plug is inserted in the opening, and the band or tie 28*c* also aids in retaining the plug in the opening.

A modified form of drapery fixture kit is illustrated in FIGS. 10 and 11 and like numerals are used to designate the same parts and like numerals followed by the postscript ′ are used to designate modified parts. In this embodiment, the rosette body member 27′ is formed with relatively thin walls, as by molding from a synthetic resin material, and the front face 27*a′*, outer periphery 27*c′* and central opening 27*d′* preferably have generally the same configuration as that shown in the previous embodiment. The rear side 27*b′* has a radially concave configuration and the fabric receiving groove or recess 27*e′* is formed by radially inner and outer annular ribs 27*f′* and 27*g′*. The radially inner rib 27′ advantageously has at least portions thereof indicated at 27*f″* that extend rearwardly a greater distance than the outer ribs 27*g′*, and the bracket extension 23′ is formed with end fingers 23*a′* and 23*b′* that are adapted to grip the rearwardly projecting portions 27*f″* of the ribs 27*f*. The bracket extension 23′ is formed of resilient metal or plastic and has fingers 23*a′* and 23*b′* that are adapted to resiliently engage opposite sides of the rearwardly extending portions 27″ of the inner rib to support the rosette. A spur 23*c′* (FIG. 11) is formed on one of the fingers 23*a′* to engage the extended inner flange 27*f″* inhibit detachment. The bracket extension 23′ can be mounted on the bracket arm 22 in the position shown in FIGS. 10 and 11 to support the rosette in a position offset upwardly from the mounting bracket and can also be mounted on the bracket arm in an inverted position to support the rosette in a position offset downwardly from the mounting bracket. As in the preceding embodiment a resilient flexible fabric retaining strip 29′ is provided and adapted to be pressed into the fabric receiving groove to retain the fabric therein.

In this embodiment, the plug member 28′ is also conveniently molded of a synthetic resin material and has a head 28*a′* and rearwardly extending portions 23*b′* that define a stem dimensioned for insertion into the opening 27*d*, in the body member. The body member 20*a* is also adapted to be covered by the fabric to form a fabric rosette in the same manner as the preceding embodiment and the plug 28′ can also be used with or without a fabric covering.

Figure 1:
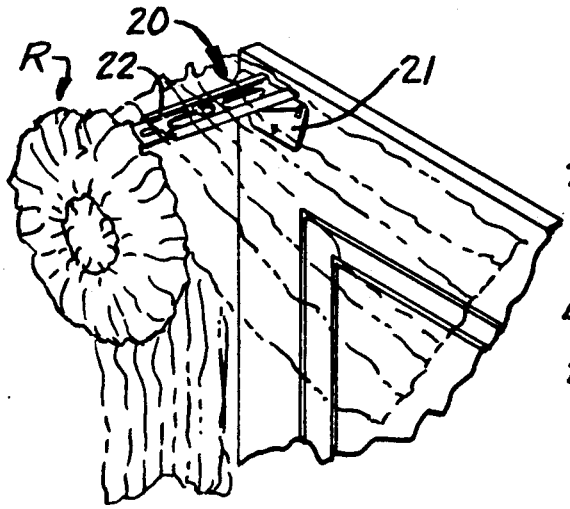
FIG. 1 is a fragmentary perspective view of the drapery fixture used as a drapery swag holder.

The drapery fixture is adapted for mounting adjacent the upper edge of the drapery at each side of the window opening to support a drapery swag as shown in FIG. 1, and the drapery fixture can also be mounted intermediate the sides of the window opening above the drapery to provide intermediate swag support in wide window installations. When used as a swag holder, a fabric retaining clip 39 is advantageously provided and mounted on the bracket as by the fastener 25 to hold the swag against sliding relative to the mounting bracket. The fabric clip can be of various different constructions and, as shown, the slip has a U-shaped configuration and is mounted adjacent the outer end of the mounting bracket with the open side of the clip facing rearwardly. The clip is formed of a resilient material such as a resilient polycarbonate and the free leg of the clip has a nose portion 39*a* arranged to grip a forward portion of the fabric swag that overlies the mounting bracket.

Figure 2:
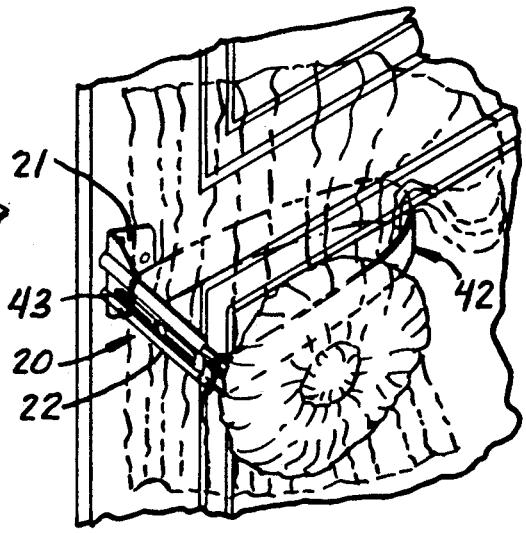
FIG. 2 is a fragmentary perspective view of the drapery fixture used as a drapery tie-back holder.

The drapery fixture is also adapted for mounting at the side of a window opening intermediate the upper and lower ends of the drape, to support a drapery tie-back 42 as shown in FIG. 2. The tie-back can be formed of the same material as the drapery or a contrasting material and as shown in FIG. 2, the tie-back has hooks 43 such as drapery hooks at the end to engage the arm on the wall bracket and hold the tie-back in position. If desired, the arm can be covered with fabric, as by wrapping or forming a tubular sleeve that fits over the arm.

The embodiments of the invention in which an exclusive property or privilege is claimed are defined as follows:

1. A drapery fixture kit for use as a drapery swag holder or a drapery tie-back holder, comprising a mounting bracket having a rear mounting portion and arm means extending forwardly from the rear mounting portion, rosette components for use with a piece of fabric for forming a fabric rosette, the rosette components including a shape retaining rosette body member having a front face, a rear side, an outer periphery and a central opening generally centrally of the outer periphery, the body having an outer diameter in the range from about 3 inches to about 6 inches, the central opening having a diameter in the range from one-quarter to one-half the outer diameter of the body, a plug member dimensioned for insertion into the central opening in the body member form the front face of the latter for retaining a fabric piece adjacent the center of the front face of the body member, rear fabric retaining means for attaching a fabric piece to the rear side of the body member in a locus inwardly of the outer periphery of the body member and outwardly of the central opening, and rosette mounting means for detachably connecting a forward end to the arm means to the rear side of the rosette body member, said rear fabric retaining means including annular fabric receiving groove means at the rear side f the body and strip means receivable in the groove means.

2. A drapery fixture kit according to claim 1 wherein the rosette mounting means is constructed and arranged to attach the forward end to the arm means to the rear side of the body member at a location outwardly of the central opening and inwardly of said rear fabric retaining means.

3. A drapery fixture kit for use as a drapery sway holder or a drapery tie-back holder, comprising a mounting bracket having a rear mounting portion and arm means extending forwardly from the rear mounting portion, rosette components or use with a piece of fabric for forming a fabric rosette, the rosette components including shape retaining rosette body member having a front face, a rear side, an outer periphery and a central opening generally centrally of the outer periphery, a plug member dimensioned for insertion into the central opening in the body member from the front face of the latter for retaining a fabric piece adjacent the center of the front face of the body member, rear fabric retaining means for attaching a fabric piece to the rear side to the body member in a locus inwardly of the outer periphery of the body member and outwardly of the central opening, and rosette mounting means for detachably connecting a forward end of the arm means to the rear side of the rosette body member, the rear fabric retaining means including annular fabric receiving groove means at the rear side of the body member and a resilient flexible fabric retaining strip receivable in the groove means.

4. A drapery fixture kit according to claim 3 wherein the rosette mounting means is constructed and arranged to attach the forward end of the arm means to the rear side of the body member at a location outwardly of the central opening and inwardly of said groove means.

5. A drapery fixture kit according to claim 3 wherein the front face of the rosette body member has a concave central portion around said opening and a convex portion outwardly of said central portion and merging with the outer periphery.

6. A drapery fixture kit according to claim 3 wherein said plug member has a front head portion larger than said opening.

7. A drapery fixture kit according to claim 6 including means on said plug member for releasably retaining the plug member in the opening in the rosette body member.

8. A drapery fixture for use as a drapery swag holder or a drapery tie-back holder comprising, a mounting bracket having a rear mounting portion and arm means extending forwardly from the rear mounting portion, a fabric covered rosette including a shape retaining rosette body member having a front face, a rear side, an outer periphery and a central opening generally centrally of the outer periphery, a fabric piece having a portion disposed in said central opening, a plug member extending into said opening from the front face of the body member and retaining the fabric piece therein, the fabric piece extending outwardly from the central opening at the front face of the rosette body member and having a fold-back portion at the rear side of the body member, means attaching the fold back portion of the fabric piece to the rear side of the rosette body member in a locus outwardly of the central opening, and mounting means for detachably connecting a forward end of the arm means to the rear side of the rosette body member.

9. A drapery fixture according to claim 8 wherein the means attaching the fabric piece to the rear side of the body member includes annular fabric receiving groove means at the rear side of the body and a resilient flexible fabric retaining strip receivable in the groove means.

10. A drapery fixture according to claim 8 including a second piece of fabric covering a front end of the plug member and extending along the plug into the central opening in the rosette base.

11. A drapery fixture according to claim 8 wherein the mounting means connects the forward end of the arm means to the rear side of the body member at a location outwardly of the central opening.

12. A drapery fixture for use as a drapery swag holder or a drapery tie-back holder comprising, a mounting bracket having a rear mounting portion and arm means extending forwardly from the rear mounting portion, a fabric covered rosette including a shape retaining rosette body member having a front face, a rear side, an outer periphery and a central opening generally centrally of the outer periphery, a fabric piece having a portion disposed in said central opening, a plug member extending into said opening for the front face to the body member and retaining the fabric piece therein, the fabric piece extending outwardly from eh central opening at the front face of the rosette body member and having a fold-back portion at the rear side of the body member, means attaching the fold back portion the fabric piece to the rear side of the rosette body member in a locus outwardly of the central opening, and counting means for detachably connecting the forward end of the arm means to the rosette.

* * * * *

UNITED STATES PATENT AND TRADEMARK OFFICE

CERTIFICATE OF CORRECTION

PATENT NO. : 5,144,997

DATED : September 8, 1992

INVENTOR(S) : Angelo M. Marasco et al

It is certified that error appears in the above-identified patent and that said Letters Patent is hereby corrected as shown below:

Claim 1, column 5, line 28, Change "to" (first occurrence) to -- of --;
line 31, Change "f" to -- of --;
Claim 3, column 5, line 39, Change "sway" to -- swag --;
line 43, Change "or" to -- for --;
line 52, Change "to" (second occurrence) to -- of --;
Claim 12, column 6, line 55, Change "for" to -- from --;
line 55, Change "to" to -- of --;
line 57, Change "eh" to -- the --;
line 60, Insert -- of -- after "portion";
line 62, Change "count" to -- mount --.

Signed and Sealed this

Fourteenth Day of September, 1993

*Attest:*

*Attesting Officer*

BRUCE LEHMAN

*Commissioner of Patents and Trademarks*